US007454938B2

(12) United States Patent
Morel et al.

(10) Patent No.: US 7,454,938 B2
(45) Date of Patent: Nov. 25, 2008

(54) METHOD AND DEVICE FOR ROLLING UP A STRIP

(75) Inventors: Francis Morel, Saint-Etienne (FR); Christelle Vidal, Saint-Laurent d'Agny (FR); Vincent Philippaux, Montbrisson (FR); Jean Perret, Essertines-En-Chatelneuf (FR)

(73) Assignee: Siemens Vai Metals Technologies SAS, Saint Chamond (FR)

( * ) Notice: Subject to any disclaimer, the term of this patent is extended or adjusted under 35 U.S.C. 154(b) by 0 days.

(21) Appl. No.: 11/665,267

(22) PCT Filed: Oct. 12, 2005

(86) PCT No.: PCT/FR2005/050842

§ 371 (c)(1),
(2), (4) Date: Apr. 12, 2007

(87) PCT Pub. No.: WO2006/040497

PCT Pub. Date: Apr. 20, 2006

(65) Prior Publication Data

US 2007/0262184 A1 Nov. 15, 2007

(30) Foreign Application Priority Data

Oct. 12, 2004 (FR) ..... 04 10766

(51) Int. Cl.
*B21C 47/00* (2006.01)

(52) U.S. Cl. ..... 72/148; 72/146; 242/533.6

(58) Field of Classification Search ..... 72/146, 72/148, 172, 173, 178, 205, 371; 242/533.4, 242/533.5, 533.6
See application file for complete search history.

(56) References Cited

U.S. PATENT DOCUMENTS

| | | | | |
|---|---|---|---|---|
| 2,312,428 | A * | 3/1943 | Lorig | 72/146 |
| 2,756,942 | A * | 7/1956 | Sieger | 72/148 |
| 2,918,226 | A | 12/1959 | O'Brien | |
| 3,587,274 | A | 6/1971 | Rotter | |
| 5,950,476 | A * | 9/1999 | Brashear | 72/205 |

FOREIGN PATENT DOCUMENTS

| | | |
|---|---|---|
| EP | 0 118 062 A | 9/1984 |
| JP | 01 113119 A | 5/1989 |

* cited by examiner

*Primary Examiner*—Derris H. Banks
*Assistant Examiner*—Debra M Wolfe
(74) *Attorney, Agent, or Firm*—Arent Fox LLP.

(57) ABSTRACT

The invention relates to a method and a device for winding a band into a coil on a chuck driven into rotation around its axis, by means of a winding assembly including a roll (3) for applying the band (1), by an internal face (11), to the chuck (2) means (62) for pushing the roll (3) towards the chuck (2) and a bending plate (4) having a curved face (40) for guiding the band (1) along the external face (20) of the chuck (2).

According to the invention, the application roll (3) is mounted rotatably on a mobile supporting chassis (6) whereon rests at least one hydraulic jack (62) forming a thrust means capable of exerting an adjustable pinching load of the band (1) between the chuck and the application roll (3) and the supporting chassis (6) carries, immediately upstream of the application roll (3), an additional roll (5) whereon the band (1) may rest, taking into account a predictable bending effect (1) upstream of the application roll (3), said application (3) and additional (5) rolls being driven into rotation so as to exert to the external face (12) of the band (1) a driving effect by friction which is added to the effect exerted by the chuck to the internal face (11).

17 Claims, 3 Drawing Sheets

METHOD AND DEVICE FOR ROLLING UP A STRIP

CROSS-REFERENCE TO RELATED APPLICATION

This application is a National Stage entry of International Application No. PCT/FR2005/050842, filed Oct. 12, 2005, the entire specification claims and drawings of which are incorporated herewith by reference.

BACKGROUND OF THE INVENTION

The invention relates to a method and a plant for winding a ship into a coil and applies in particular to the winding of a steel band after hot rolling.

When exiting out of a hot band train, the steel band is carried generally on a roller table, towards one or several coiling machines situated at a certain distance downstream of the roller table, generally under it.

Upstream of the coiling machines, the band is driven by a clamping device, followed by guiding means which direct the band towards a rotary chuck whereon the band, driven by friction, is wound in superimposed turns.

For winding a new band, the head of the band is applied on the external face of the rotary chuck in order to be driven by friction downstream. Then, the band is guided by a curved bending plate so as to be bent while remaining applied on the chuck, along an angular sector which increases gradually, which enhances the friction driving effect. After one revolution, the head of the band passes below the internal face of the hand to form a second turn and so on. In order to keep the tension necessary for winding, the band is held upstream by a device including, usually, a deflecting roll and a pinch roll driven into rotation at an angular velocity slightly smaller than that of the chuck, wherein the band may thus be stretched along a theoretical winding plane tangent, upstream, to the deflecting roll, along a generatrix thereof, and, downstream, to the coil being winding. Usually, the chuck is retractable so as to reduce in diameter to enable the removal of the coil, once it has reached the requested diameter.

The document U.S. Pat. No. 2,918,226, for instance, describes a winding plant of such type including, downstream of a deflecting roll placed at the outlet of a roller table, a rotary chuck arranged inside a pit and associated with two winding assemblies, each comprising an application roll of the band on the cylindrical external face of the chuck and a curved bending plate for guiding the band during the winding process. In the arrangement of document U.S. Pat. No. 2,918,226, the assembly is placed on a supporting chassis mounted so that it is capable of being pivoted around an axis parallel to the axis of the chuck and actuated by a jack, so as to move between a spaced apart position and a working position for which the bending plate is substantially parallel to the external face of the chuck. On the other hand, the application roll is mounted itself on an auxiliary chassis hinged on the supporting chassis of the bending plate and pushed towards the chuck by a spring so as to exert an elastic force to apply the band on the chuck, along a pushing direction running through a back-up generatrix of the external face of the chuck and the axis thereof.

Moreover, the application roll can be driven into rotation around its axis in a reverse direction relative to the direction of rotation of the chuck, in order to apply, to the external face of the band, an additional driving friction force which is added to the main driving friction force exerted by the chuck on the internal face of the band.

At the beginning of the winding process, the head of the band may rest on the bending plate situated downstream of the application roll and is guided in the annular gap between the bending plate and the external face of the chuck so as to be winded around the chuck. After one revolution, the head of the band may run below the hand so as to form a second turn, the application roll, pushed by a spring, being capable to move apart slightly.

In a more developed embodiment described in document U.S. Pat. No. 3,587,274, an additional roll is mounted, upstream of the application roll and of the chuck, on a chassis hinged around an axis, in order to exert a pre-bending torque on the band.

Until now, such devices were satisfactory since they were used for winding steel bands with a relative small thickness, for instance ranging between 2 and 12 mm.

For such thicknesses, indeed, the band bends easily and may be guided in the annular gap provided between the chuck and the bending plate, so as to be applied on the cylindrical face of the chuck in order to be driven by friction.

However, it is now contemplated to use devices of such type for winding hot bands with increased thicknesses, up to for example 25 mm. Moreover, one may have to wind products with high elastic limits, for instance of the order of 370 MPa at the temperature of use.

Still, it has appeared that, for relatively high thicknesses, the usual arrangement of the type represented on FIG. 1 does not enable sufficient bending of the band, in particular at the beginning of its winding process.

At that time, indeed, the band is applied only on a small angular sector of the chuck, and the main driving force exerted by the chuck on the internal face of the band depends essentially of the pressure exerted by the application roll of the band to the chuck.

However, in the previous arrangements disclosed by the documents mentioned above, this pushing force, exerted by a spring system or an elastic stop, would be insufficient to enable the winding of a hot band which is relatively thick and rigid.

SUMMARY OF THE INVENTION

The purpose of the invention is to resolve such problems thanks to a new arrangement enabling, in particular, to increase considerably the downwards driving energy transmitted to the band by friction and, thus, the bending energy, which enables to wind relatively thick metal sheets up to, for instance, 25 mm.

The invention therefore relates, generally, to a plant for winding into a coil a band-type product running along a longitudinal direction, including a winding chuck driven into rotation around an axis orthogonal to the running direction and having a cylindrical external face, means for guiding the band, along a tangent running plane, upstream, of a deflecting roll and, downstream, of the chuck, means for the application of the band, by an internal face, on the external face of the chuck along a back-up generatrix and a bending plate having a curved face for guiding the band along the external face of the chuck, wherein said means of application include an application roll revolving around an axis parallel to the axis of the chuck, and a means for pushing said roll toward the chuck along a pushing plane running substantially through the axes of the chuck and of the application roll, the application roll being driven into rotation around its axis in a reverse direction relative to the direction of rotation of the chuck and at a corresponding tangential velocity, for applying a downstream driving force on each of both faces, respectively internal and external of the band.

According to the invention, the application roll is mounted rotatably on a mobile supporting chassis whereon rests at least one hydraulic jack which also rets in an opposite direction on a fixed portion so as to exert an adjustable pinching force on load of the band between the chuck and the application roll, and an additional roll is mounted rotatably on said mobile supporting chassis of the application roll, upstream of the application roll in the winding direction, and is driven into rotation around its axis in a reverse direction and at a tangential velocity corresponding to the velocity of the chuck, wherein said additional roll is slightly spaced apart from the running plane between the deflecting roll and the chuck, by a distance corresponding to a predictable bending effect of the band upstream of the application roll, taking its rigidity into account.

Preferably, the running plane between the deflecting roll and the chuck, is tangent to the chuck along a generatrix situated slightly upstream of the pushing plane of the application roll toward the chuck.

According to another particularly advantageous characteristic of the invention, the diameter and the position of the axis of the additional roll on the chassis are determined so that, taking into account the bending of the band between the deflecting roll and the chuck, the band can rest by its external face on said additional roll.

In a preferred embodiment, the additional roll is placed upstream as close as possible of the application roll and its diameter ranges between 0.5 and 1 time the diameter of the application roll.

The invention also covers the method which consists in arranging, upstream and close to the application roll, an additional roll driven into rotation around its axis and enabling to exert on the band a driving downwards force which may replace the driving force exerted by the application when the application roll is spaced apart relative to the winding plane of the chuck.

In particular, the diameter and the position of the axis of the additional roll are determined so that, taking into account the bending of the band between the deflecting roll and the chuck, the external face of the band may contact the additional roll, when the external face of the application roll is spaced apart relative to the external face of the band, in the pushing plane, beyond a quarter of the thickness of the band.

In order to keep the band applied on the external face of the chuck, after running through a first winding assembly including successively an additional roll, an application roll and a bending plate, the plant includes at least one second winding assembly including a second application roll, resting on the external face of the band immediately downstream of the outlet end of the first bending plate, and a second cylindrical bending plate, having an inlet end placed immediately downstream of the second application roll and an outlet end.

In a preferred embodiment, the device includes three winding assemblies arranged successively around the chuck in the winding direction, respectively a first assembly covering an angular sector of the chuck of approximately one quadrant, between a first application roll and the outlet end of a first bending plate, a second assembly covering an sector of approximately one quadrant, between a second application roll and the outlet end of a second bending plate, and a third assembly covering an angular sector of at least one quadrant, between a third application roll and a third bending plate, extending to an outlet end situated as close as possible of the internal face of the band, upstream of the first application roll.

However, according to another particularly advantageous embodiment, the device includes four successive winding assemblies, respectively, three assemblies each covering an angular sector of at most one quadrant between an application roll and the outlet end of a bending plate, and a fourth assembly including at least a fourth application roll arranged immediately downstream of the outlet end of the third bending plate.

BRIEF DESCRIPTION OF THE DRAWINGS

The invention also covers other advantageous arrangements which will appear in the following description of certain particular embodiments, given by way of example and represented on the appended drawings.

DETAILED DESCRIPTION OF THE INVENTION

Figure 1:
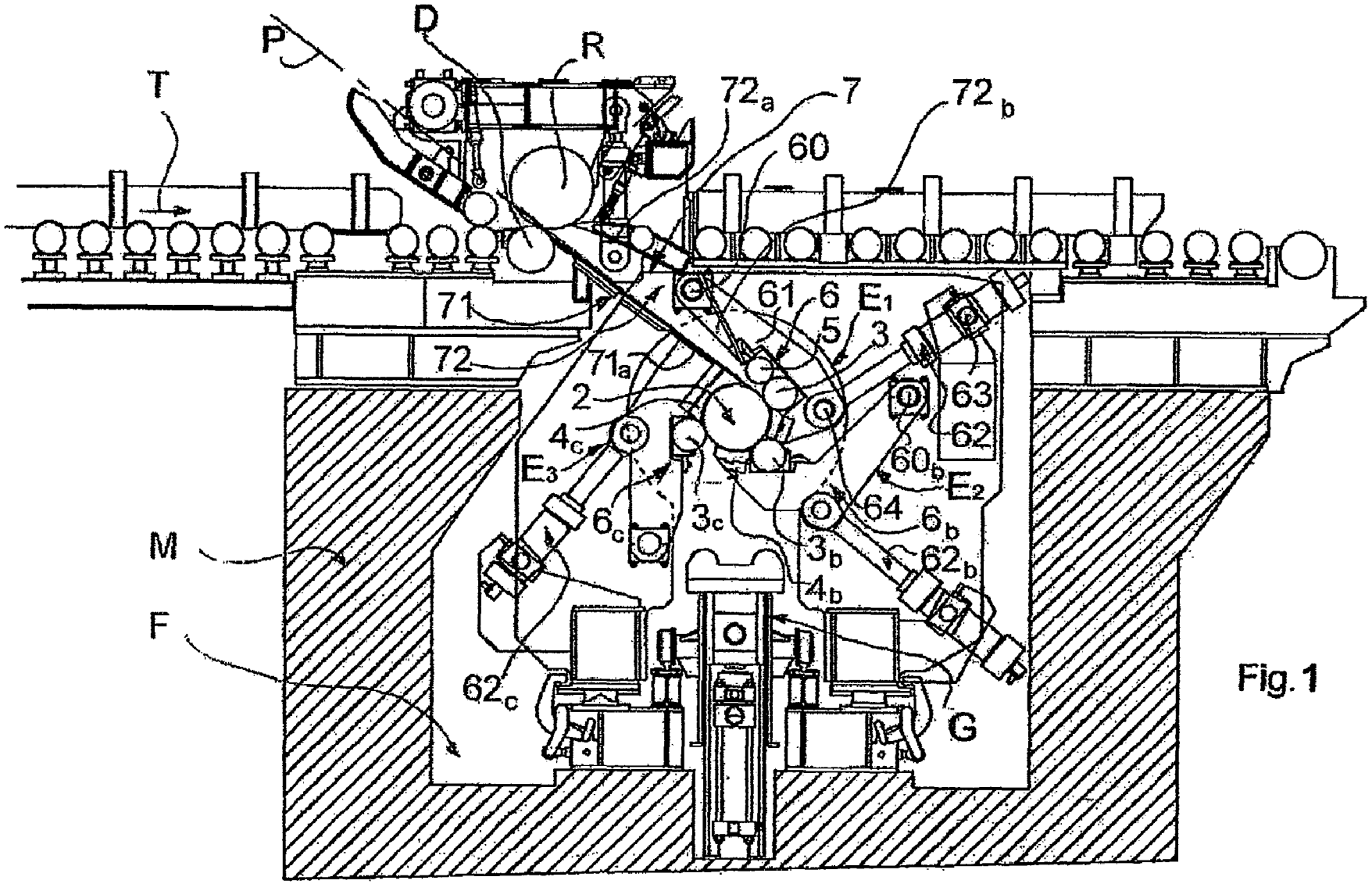
FIG. 1 is a general view of a winding device according to the invention, at the outlet of a roller table.

FIG. 1 represents the assembly of a winding device of the type described, for instance, in document U.S. Pat. No. 2,918,226 mentioned above. It includes hence a winding chuck 2, placed in a pit F, at the outlet of a roller table T on which a metal band 1 runs, driven by a pinching-deflecting device including a deflecting roll D which the band is deflected downwards to be directed toward the chuck 2, by rolling about said deflecting roll so as to be driven by friction, and a pinching roll R which is driven into rotation at a velocity slightly smaller than that of the chuck, so as to hold the band 1 which can thus be stretched so as to be winded into tight turns around the chuck 2.

As it is also known, the band 1 is applied on the chuck 2 by a roll 3 applying a pushing force along a radial plane Q running through the axes 21 of the chuck 2 and 31 of the roll 3. This roll 3 is, on the other hand, followed by a bending plate 4 having a curved face substantially parallel to the external face 20 of the chuck 2 and spaced apart therefrom by a distance at least equal to the thickness of the band.

Consequently, the band 1, which is clamped between the application roll 3 and the chuck 2 is, driven by friction in the annular space delineated between the bending plate and the chuck 2 and winds gradually around said chuck.

The application roll 3 and the associated bending plate 4 form a winding assembly E carried by a supporting chassis 6 mounted so as to be pivoted around an axis 60 so as to be able to move under the action of a jack 62 between the winding position, represented on FIG. 1, and a spaced apart position enabling to remove the coil once wound.

In the arrangement of document U.S. Pat. No. 2,918,226, the chuck is associated with two winding assemblies each carried by a supporting chassis.

As will be seen below, the arrangements according to the invention enable to reduce the angular sector covered by the bending plate and, thus, to position at least three winding assemblies around the chuck as represented on FIG. 1.

As stated above, the winding device of document U.S. Pat. No. 2,918,226 is provided for winding a band of relatively small thickness which may thus be stretched along the theoretical running plane (P) tangent both, upstream, to a generatrix of the deflecting roll D and, downstream, to a generatrix 22 of the chuck 2.

The invention, conversely, is provided for winding a hot band of greater thickness, up to 25 mm and, consequently, more rigid. It is then more advantageous, as shown on FIG. 2, that the generatrix 23, through which runs the pushing plane Q, is slightly offset downwards relative to the generatrix 22 corresponding to the theoretical running direction of the band, so that the band can be exposed to a pre-bending torque before being clamped on the chuck by the application roll.

Moreover, in the arrangement of document U.S. Pat. No. 2,918,226, the application roll is carried by a supporting chassis mounted rotatably on the main supporting chassis of the bending plate and is simply pushed toward the chuck by a spring resting on said chassis.

In the invention, conversely, the application roll 3 is mounted rotatably directly on the chassis 6 supporting the bending plate 4 and the assembly is pushed toward the chuck by the operating jack 62 which rests, in one direction, on the foundation block by a fixed hinge 63 and in the other direction on the chassis 6 by a hinge 64.

This jack 62 is provided, as previously, to control the displacement of the supporting chassis 6 between the winding position represented on FIG. 1 and a spaced apart position enabling to revoke the coil. However, since the application roll 3 is mounted rotatably directly on chassis 6, jack 62 may form in itself a means for adjusting the pushing force $F_3$ exerted by the application roll 3 on the chuck 2 along the back-up generatrix 23. The band 1 thus clamped between the chuck 2 and the application roll 3 is then subjected to two opposite forces, the pushing force $F_3$ applied by the roll 3 on the external face 12 of the band and the reaction force $F_2$ exerted by the chuck 2 on the internal face 11.

This pushing force exerted, according to the invention, by the jack(s) 62 for operating chassis 6 may be much more significant than in the previous arrangements, since it is balanced by the reaction of the chuck and depends simply on the pushing capacity of the jack(s) 62 as well as on the resistance of the chassis 6 and of the hinges 63, 64. Moreover, using one or several jacks enables to control easily the force exerted by hydraulic means allowing, in particular, the pressure applied to be limited.

As shown on FIG. 1, at the outlet of the roller table T, the metal band 1 is deflected by the deflecting roll D which is associated with the clamping roll R and thus driven downwards, i.e. to the right on FIG. 1, at a certain running velocity which depends on the rotational velocity of the rolls R, D.

The band is then directed by a guiding chute which will be described below, toward the chuck 2 placed in the pit F, substantially along a theoretical running plane P tangent, upstream, to a generatrix of the deflecting roll D and, downstream, to a generatrix 22 of the chuck 2. The head 13 of the band moves between the chuck 2 and the application roll 3, which is driven into rotation in the running direction, and then contacts the curved bending plate 4.

By designating by $f_2$ and $f_3$, the friction coefficients of the band, respectively on the chuck 2 and the application roll 3, the band is subjected to a drag downwards force equal to $F_2f_2+F_3f_3$, $F_3$ being the radial pushing force of the roll 3 exerted by the jack 62 and $F_2$ the opposite reaction force of the chuck 2.

Figure 3:
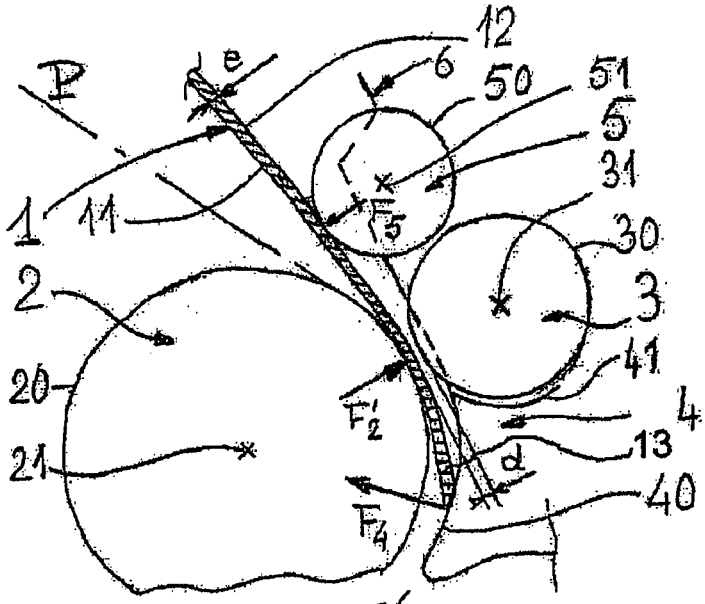
FIG. 3 and FIG. 4 show two successive bending steps of the head of the band.

When the head 13 of the band contacts the bending plate 4, in the position represented on FIG. 3, it is subjected to a deflection force $F_4$ which tends to bring it back along the external face 20 of the chuck 2.

It results that the bending plate 4 opposes to the drag of the band a resisting force $F_4f_4$, $f_4$ being the friction coefficient of the head 13 of the band on the plate 4.

To enable bending and winding of the band, the drag downwards force applied by the chuck and the application roll on both faces of the band must therefore be greater than the resisting forces opposed by the bending plate and the following relation is obtained:

$$F_4f_4 \leq F_2f_2+F_3f_3 \quad (1)$$

However, the pushing effect exerted by the head 13 of the band 1 on the bending plate 4 carried by the supporting chassis 6 tends to rotate said chassis 6 around its axis 60 by spacing it away from the chuck 2, with the application roll 3 which, according to the invention is mounted rotatably directly on this chassis 6. Hence it appears that the external face 30 of the roll moves apart from the external face 12 of the band 1 by a distance (d) and that the roll 3 is not applied on the band, the driving effect $F_3f_3$ being, thus, eliminated.

Reversely, the bending effect exerted by the curved plate 4 on the head 13 of the band tends to keep its internal face 11 applied on the external face 20 of the chuck 2 with an application force $F'_2$ and, simultaneously to increase the application angular sector on which said load is distributed. Consequently, the band 1 is subjected, by the chuck, to a driving force $F'_2f'_2$.

However, such driving force resulting solely from the bending of the band can be insufficient to overcome the resisting force applied by the bending plate 4 to the head 13 of the band.

Consequently, according to another essential characteristic of the invention, the supporting chassis 6 carries an additional roll 5 which is mounted, rotatably around its axis 51, upstream in the running direction, of the application roll 3 and which is sized and positioned so that, taking into account the bending effect of the band at the back-up generatrix 23, the external face 12 of the band may rest upon the external face 50 of this additional roll 5 which therefore exerts a pushing force $F_5$. This additional roll 5 is driven into rotation around its axis 51 at a tangential velocity corresponding to the velocity of the chuck 2, so as to be capable of exerting on the external face 12 of the band 1 a driving downwards force $F_5f_5$ which, in the case where the application roll 3 is spaced away, may be added to or replace the driving of the application roll 3.

Thanks to this additional roll 5, the relation translating the resistance opposed by the bending plate 4 to the drag of the band 1 may then be expressed as follows:

$$F_4f_4 \leq F'_2f'_2+F_5f_5+F_3f_3 \quad (2)$$

In this first relation, the pushing forces $F_3$, $F_5$ exerted, respectively, by the application roll 3 and the additional roll 5 depend on the bending effect of the band and may be equal to zero but by replacing one with the other.

Figure 4:
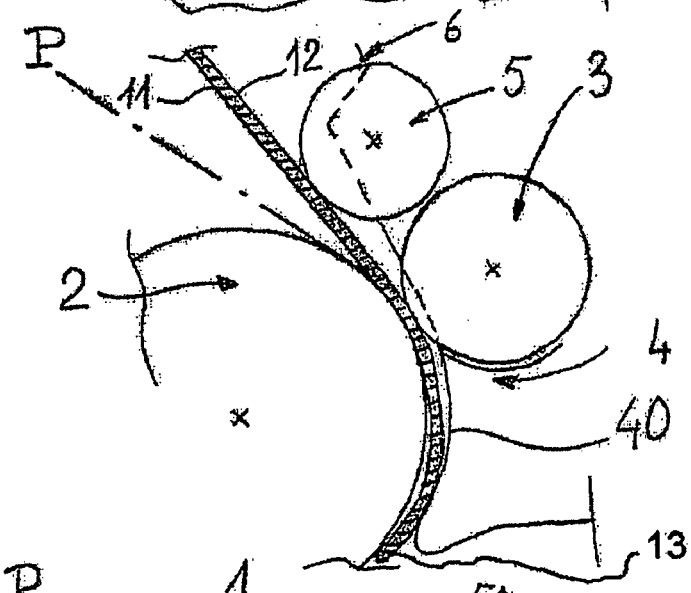

Thanks to the additional driving effect exerted by the additional roll 5, the drag of the band may be continued while determining the bending of the head 13 which is deflected toward the external face 20 of the chuck 2, in the position represented on FIG. 4. The rotational effect to the outside of the supporting chassis 6 decreases and the application roll 3 comes back gradually in contact with the external face 12 of the band 1 which may then be driven simultaneously by both rolls 3 and 5 and the chuck 2.

Advantageously, at the outlet of the bending plate 4, the head of the band may be picked up by a second application roll itself followed by a second bending plate, so as to keep the band applied on the external face 20 of the chuck 2 during the winding process of the band.

It follows that the angular sector of application of the internal face 11 of the band on the chuck increases gradually and that the driving effect of the chuck becomes predominant. The tension exerted on the band may hence increase and, according to the rigidity of the band, its external face 12 may move away from the external face 50 of the additional roll 5, in order to adopt the position represented on FIG. 2.

Figure 2:
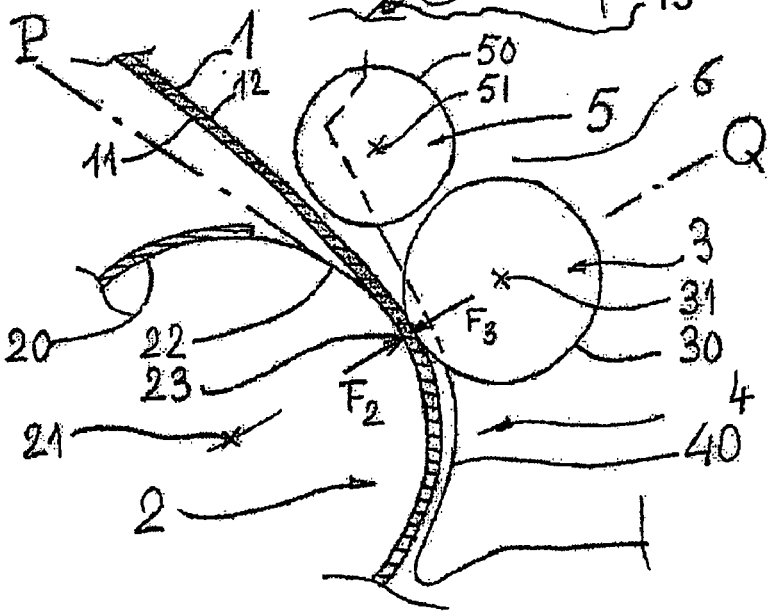
FIG. 2 is an operating diagram of the driving and bending system of the band.

The path followed by the band 1 upstream of the chuck 2 and, in particular, the variation of its spacing relative to the theoretical running plane P, as represented schematically on FIGS. 2, 3, 4, may advantageously be provided by simulation while taking into account the diameter of the chuck, the thickness of the band and its mechanical features, especially its rigidity and its elastic limit. Thanks to this representation, it is possible to determine the predictable bending effect of the band at the back-up generatrix 23, especially when the head 13 contacts the bending plate 6 and to deduce therefrom the sizes and the positioning of the additional roll 5 so that the band is applied to the external face 50 of this additional roll, when the driving effect of the application roll 3 decreases and disappears due to the spacing apart of the supporting chassis 6.

Generally, the additional roll 5 will be placed as close as possible of the application roll 3, upstream thereof. Its diameter may range, for instance, between 0.5 and one time the diameter of the application roll 3.

As a matter of principle, the diameter and the position of the additional roll 5 on the chassis 6 will be determined so that, taking into account the predictable bending effect of the band between the deflecting roll D and the chuck 2, the external face 12 of the band can contact the additional roll 5 for a distance d of the external face 30 of the application roll 3 relative to the external face 12 of the band greater than a quarter of the thickness e of the band at the pushing plane Q.

It appears therefore that the assembly, according to the invention, of the application roll 3 and of an additional roll 5 on the same chassis 6 and the use, as a pushing means, of one or several hydraulic jacks 62, enables to adjust hydraulically the pushing force by adapting it to the bending resistance of the band so that the sum of the driving forces exerted by friction, respectively, on the internal face 11 of the band 1 by the chuck 2 and on its external face 12, either by the application roll 3, or by the additional roll 5, or by both rolls, determines a longitudinal pushing force capable of causing sufficient bending of the band in order to wind it around the chuck and to have it picked up by said chuck.

Moreover, in order to keep the band in contact with the chuck until a complete turn has been wound, it is known to have several winding assemblies distributed around the chuck.

For instance, in the arrangement described by document U.S. Pat. No. 2,918,226, the winding chuck is associated with two winding assemblies each including an application roll and a bending plate which extends over a large angular sector, close to half a turn. Such an arrangement is provided, indeed, for a band of relatively small thickness which may be guided in a reduced space between the bending plate and the chuck.

The invention, conversely, is provided for bands of relatively large thicknesses, up to 25 mm, and the interval i between the bending plate 4 and the external face 20 of the chuck is hence relatively significant. It ensues, besides, that the angular application sector of the internal face 11 of the band on the chuck is thus increased when the head of the band contacts the bending plate 4 and starts to be bent.

However, the angular sector covered by the bending plate 4, downstream of the application roll 3, may advantageously be reduced so that the head 13 of the band is picked up by a second application roll as soon as it comes back in contact with the external face 20 of the chuck 2.

Consequently, it is advantageous, as represented on FIG. 1, to arrange around the chuck 2, three successive winding assemblies, respectively a first assembly E1, a second assembly E2 and a third assembly E3.

Therefore, the first winding assembly E1 includes successively in the winding direction the additional roll 5, a first application roll 3 and a first bending plate 4, the assembly being mounted at the end of the supporting chassis 6 which includes essentially two arms 61 integral in rotation and pivoting around a shaft 60 under the action of at least one hydraulic jack 62 having one hinged element, around an axis 63, on a fixed frame or directly on the foundation block M, and a second hinged element, around an axis 64, on the arms 61 of the chassis 6, for instance at the pinch roll 3. Both arms 61 of the chassis 6 are prolongated, beyond the axis 64, by an elbowed portion 65 turned toward the chuck 2 and carrying, at the end thereof, the bending plate 4.

This bending plate 4 exhibits a cylindrical internal face 40, with generatrices parallel to the axis O of the chuck, with an upstream end 41 extending substantially up to the pinching roll 3 in the dihedron opening between the external face 30 of the latter and the external face 20 of the chuck 2.

The second winding assembly E2 includes a second application roll 3*b* and a second bending plate 4*b* mounted on a chassis 6*b* pivoting around a fixed axis 63*b* under the action of a jack 62*b*.

Similarly, the three winding assembly E3 includes a pinch roll 3*c* and a bending plate 4*c* mounted on a chassis 6*c*, the pivoting of which can be controlled by a jack 62*c*.

Once a coil has been wound, the three winding assemblies E1, E2, E3 may be spaced apart from the coil by the jacks 62, 62*b*, 62*c* to enable to lower said coil, for instance on a carriage placed below the chuck 2 and including two rows of spaced apart rollers which may be laid the coil once wound.

The jacks 62, 62*b*, 62*c* then bring back the chassis 6, 6*b*, 6*c* in the winding position represented on FIG. 1.

The arrangements which have just been described enable to adapt as a function of the resistance of the band, not only the application pressures of the rolls and the chuck on both faces respectively external 12 and internal 11 of the band 1, but also the rotational torques applied by the driving engines respectively on the additional roll 5, the application roll 3 and the chuck 2, which enables the progression of the driving power necessary, not only to overcome the drag resistance which results from the friction of the band on the bending plate 4 but, also, to bring the energy necessary for bending the band. Consequently, by adjusting the application pressures and the torques applied by the engines, it is possible, thanks to the invention, to bend the band sufficiently so that is internal face 11 is applied on the external face 20 of the chuck 2, from the radial plane Q running through the axes of the chuck 2 and of the application roll 3, both other pinch rolls 3*b* and 3*c* being, themselves, centred on radial planes running through the axis O of the chuck and the back-up generatrix.

Moreover, the bending plate 4*c* associated with the third enveloping roll 3*c* can be prolongated so that the three winding assemblies cover together an angular sector of the chuck greater than three quadrants, the downstream end 42*c* of the third plate 4*c* forming a wedge engaging in the dihedron opening between the external face 20 of the chuck and the running plane P tangent thereto.

In the example represented on FIG. 1, the guiding chute 7 is formed of two sets of plates, respectively lower 71 and upper 72. The lower assembly 71 includes a series of plates aligned along the running plane P of the band, tangent, upstream, to the deflecting roll D and, downstream, to the chuck 2. Advantageously, the last guiding plate 71*a* is provided directly on the chassis 6*c* of the third winding assembly E3.

The upper guide 72 can be formed, advantageously, of a first plate 72*a* having a nose engaged into the running plane between both pinch rolls D, R and a second plate 72*b* which, advantageously is carried by the chassis 6 of the first winding assembly E1 and directed tangentially to the additional roll 5.

Figure 5:
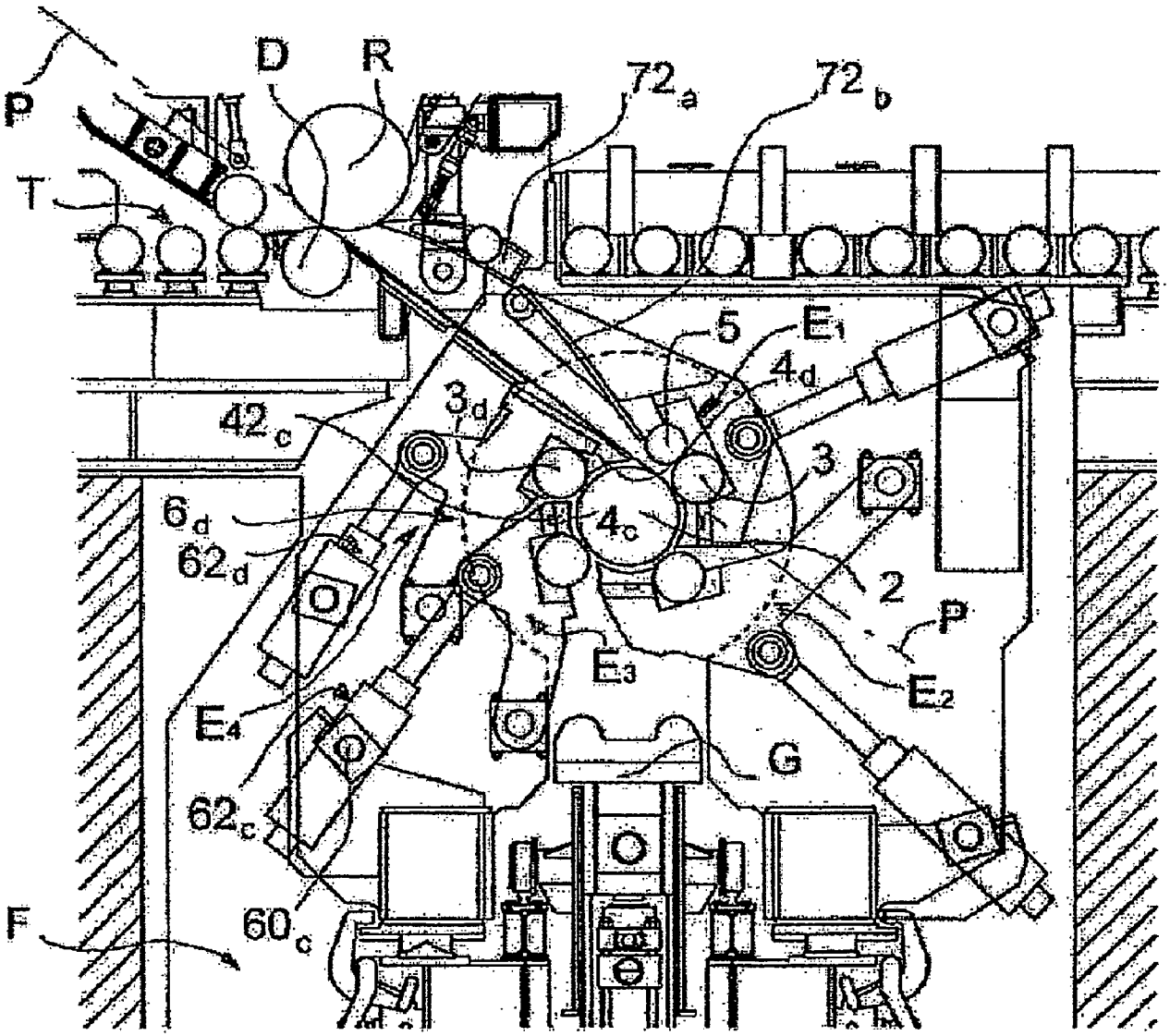
FIG. 5 is a general view of a variation of the winding device.

By reason of the perfect bending of the band obtained, even for quite a significant thickness, thanks to this additional roll 5, it is possible to reduce the length of the bending plates and to bring together the application rolls in order to provide a device with four winding assemblies, as represented on FIG. 5. In such a case, indeed, each of the winding assemblies E1, E2, E3 covers, at most, one quadrant and it is possible to place a fourth assembly in the sector remaining between the outlet 42*c* of the third bending plate 4*c* and the running plane P of the band. This fourth assembly E4 includes at least one application roll 3*d* mounted on a chassis 6*d* which may comprise a part in the form of a wedge with a curved face 4*d* engaging in the dihedron opening between the external face 20 of the chuck 2 and the running plane P.

The swivel of the chassis 6, 6*b*, 6*c*, 6*d* of the fourth assemblies is controlled by the jacks 62, 62*d*, 62*c*, 62*d*. The fixed axis 60*c* of the body of the third jack 6*c* is brought closer to the vertical plane running through the axis of the chuck in order to leave room to the jack 62*d* enabling the rotation of the chassis 6*d* of the fourth winding assembly E4. In such a case, both jacks 62*c* and 62*d* may be substantially parallel.

Obviously, the invention is not limited to the details of the embodiments which have just been described but covers conversely all the variations using, for instance, equivalents means.

In particular, the provisions of FIGS. 1 and 5 have been given by way of example, but the excellent bending provided thanks to the provisions of the invention could enable other arrangements.

The invention claimed is:

1. A plant for winding into a coil a band-type product (1) running along a longitudinal direction, including a winding chuck (2) driven into rotation around an axis orthogonal to the running direction and having a cylindrical external face (20), means (7) for guiding the band (1), along a tangent running plane (P), upstream of a deflecting roll (D) and, downstream, of the chuck (2), means (3) for the application of the band (1), by an internal face (11), on the chuck (2) along a back-up generatrix (23) and a bending plate (4) having a curved face (41) for guiding the band (1) along the external face (20) of the chuck (2), said means of application including an application roll (3) revolving around an axis (31) parallel to the axis of the chuck, and a means (62) for pushing said roll (3) towards the chuck (2) along a pushing plane (Q) running substantially through the axes (21) of the chuck (2) and (31) of the application roll (3), the application roll being driven into rotation around its axis (31) in a reverse direction relative to direction of rotation of the chuck (2), and at a corresponding tangential velocity, for applying a driving downstream on each of both faces, respectively internal (11) and external (12) of the band (1), characterised in that the application roll (3) is mounted rotatably directly on a mobile supporting chassis (6) whereon rests at least one hydraulic jack (62) as the means for pushing the application roll (3) towards the chuck (2), and resting, in an opposite direction, on a fixed portion, in order to exert an adjustable pinching force on the band (1) between the chuck and the application roll (3), in that an additional roll (5) is mounted rotatably upstream of the application roll (3) on said mobile chassis (6), and driven into rotation around its axis (51) in a reverse direction relative to the chuck (2) and at a tangential velocity corresponding to the velocity of the chuck, and in that said additional roll (5) is slightly spaced apart from the running plane (P) between the deflecting roll (D) and the chuck (2) by a distance corresponding to a predictable bending effect of the band (1) upstream of the application roll (3), taking its rigidity into account.

2. A winding plant according to claim 1, characterised in that the running plane (P) between the deflecting roll (D) and the chuck (2) is tangent to the chuck along a generatrix (22) slightly offset upstream, in the running direction, of the pushing plane (Q) of the application roll (3), towards the chuck (2).

3. A winding plant according to claim 1, characterised in that a diameter and the a position of the axis (51) of the additional roll (5) on the chassis (6) are determined so that, taking into account the bending of the band (1) between the deflecting roll (D) and the chuck (2), the band (1) can rest by its external face (12) on said additional roll (5).

4. A winding plant according to claim 1, characterised in that an external face (50) of the additional roll (5) is spaced apart outwardly relative to the running plane (P), between the deflecting roll (D) and the chuck (2), by a distance corresponding to the bending of the band upstream of the chuck (2), taking its thickness and its rigidity into account.

5. A plant according to claim 1, characterised in that a diameter of the additional roll (5) ranges between 0.5 and 1 times the diameter of the application roll (3).

6. A plant according to claim 1, characterised in that the axis (51) of the additional roll (5) is spaced apart upstream of the axis (31) of the application roll (3) by a distance slightly greater than the sum of the radii of the application roll (3) and of the additional roll (5).

7. A plant according to claim 1, characterised in that the supporting chassis (6) is mounted rotatably around a fixed axis (60).

8. A plant according to claim 1, characterised in that it includes at least two winding assemblies arranged successively around the chuck (2) in the winding direction, respectively, a first assembly (E1) including successively an additional roll (5), a first application roll (3) and a first bending plate (4) extending from an inlet end, immediately downstream of the application roll (3), and an outlet end, and at least one second assembly (E2) including a second application roll (3b) resting on the external face (12) of the band (1) immediately downstream of the outlet end of the first bending plate (4) and a second cylindrical bending plate (46) having an inlet end, situated immediately downstream of the second application roll (3*b*), and an outlet end.

9. A plant according to claim 8, characterised in that it includes at least three winding assemblies arranged successively around the chuck (2) in the winding direction, respectively a first assembly (E1) covering an angular sector of the chuck of approximately one quadrant between a first application roll (3) and the outlet end of a first bending plate (4), a second assembly (E2) covering a sector of approximately one quadrant between a second application roll (3*b*) and the outlet end of a second bending plate (4*b*), and a third assembly (E3) covering an angular sector of approximately one quadrant between a third application roll (3*c*) and a third bending plate (4*c*) extending to an outlet end situated as close as possible to the internal face (11) of the band (1), upstream of the first application roll (3).

10. A plant according to claim 8, characterised in that it includes at least four successive winding assemblies, respectively, three assemblies (E1, E2, E3) each covering one angular sector of at most one quadrant between an application roll (3, 3*b*, 3*c*) and the outlet end of a bending plate (4, 4*b*, 4*c*), and a fourth assembly (E4) including at least one pinch roll (3*d*) arranged immediately downstream of the outlet end of the third bending plate (4*c*).

11. A plant according to claim 10, characterised in that the fourth winding assembly (E4) includes a fourth bending plate (4*d*) in the form of a wedge extending as close as possible to the back-up generatrix (23) of the running plane (P) on the chuck, in the dihedron between the internal face (11) of the band and the external face (20) of the chuck (2).

12. A plant according to any of the claims 8 to 11, characterised in that each winding assembly (E1, E2, E3) is mounted on a chassis (6, 6*a*, 6*b*, 6*c*) hinged around a fixed axis (60, 60*b*, 60*c*, 60*d*) and pivoting between a winding position and a spaced apart position for removing a wound coil.

13. A plant according to claim 12, characterised in that it includes, upstream of the chuck (2), a guiding chute (7) including at least two plates converging toward a space between the additional roll and the chuck, respectively an upper plate (72*b*) carried by the chassis (6) of the first winding assembly (E1) and a lower plate (71*a*) carried by the chassis (6*c*) of the last winding assembly (E3).

14. A method for winding into a coil a band-type product (1) running along a longitudinal direction and wound around a chuck (2) driven into rotation around an axis (21) orthogonal to the running direction, by means of at least one winding assembly (E) including an application roll (3) mounted on a supporting chassis (6) and driven into rotation around an axis (31) parallel to the axis of the chuck (2)and in reverse direction relative to said chuck, means (62) for pushing the application roll(3) towards the chuck (2) along a pushing plane (Q), and a bending plate (4)provided on the chassis (6) downstream of the application roll (3) and having a curved internal face (41) for guiding the band (1) along the external face (20) of the chuck (2), characterised in that a pushing force (F3) applied by the application roll (3) to the chuck (2) is exerted by at least one hydraulic jack (62) resting on the chassis (6) towards the chuck (2) and, in the opposite direction, on a fixed portion (M), and in that, if a driving roll (3)is spaced apart to the outside, the band (1) may rest, by its external face (12), on an additional roll (5) mounted rotatably on the supporting chassis (6), upstream of the driving roll (3) and driven into rotation around an axis (51) parallel to the axis of the chuck (2) in order to exert on the band (1) a driving downstream force which is added to or replaces a driving force exerted by the application roll (3).

15. A method according to claim 14, characterised in that a diameter and position on the axis (51) of the additional roll (5) are determined so that, taking into account the bending of the band (1) between a holding device (R) and the chuck (2), the external face (12) of the band (1) can contact the additional roll (5) for a spacing of the external face (50) of the roll (5) relative to the external face (12) of the band (1) at the pushing plane (Q) greater than a quarter of a thickness (e) of the band (1).

16. A method according to any of the claims 14 or 15, characterised in that the pushing force exerted by the thrust jack ( 62) on the supporting chassis (6) and rotational torques applied to the chuck (2) and the rolls (3, 5) are adjusted, relative to the bending resistance of the band (1), so that the driving downstream force exerted by friction on the external face (12) of the band (1) by at least one of the application (3) roll and the additional (5) roll, carried by said chassis (6), and the force exerted by the chuck on the internal face (11) of the band (1) are capable of causing sufficient bending of the band (1) for winding the band around the chuck (2).

17. A method according to claim 16, characterised in that the rotational torques applied to the chuck (2) and the application roll (3) and/or the additional roll (5) enable to provide a driving downstream power capable, on the one hand, of overcoming the drag resistance opposed by the bending plate and, on the other hand, of bringing the energy necessary for bending the band.

* * * * *